US006158199A

United States Patent [19]

Emery, III et al.

[11] Patent Number: 6,158,199

[45] **Date of Patent: *Dec. 12, 2000**

[54] METHOD AND APPARATUS FOR CONTROLLING SHRINKAGE OF A THIN FILM

[76] Inventors: Clifton W. Emery, III, 6 Jo-Jo La., Westford, Mass. 01886; Frank A. James, 19 Hawthorne Village Rd., Nashua, N.H. 03062

[ * ] Notice: This patent issued on a continued prosecution application filed under 37 CFR 1.53(d), and is subject to the twenty year patent term provisions of 35 U.S.C. 154(a)(2).

[21] Appl. No.: 09/173,625

[22] Filed: Oct. 16, 1998

[51] Int. Cl.[7] ..... B65B 53/02

[52] U.S. Cl. ..... 53/442; 53/557

[58] Field of Search ..... 53/442, 557, 441

[56] References Cited

U.S. PATENT DOCUMENTS

| | | | |
|---|---|---|---|
| 2,525,651 | 10/1950 | Clunan . | |
| 3,340,670 | 9/1967 | Anderson et al. . | |
| 3,660,962 | 5/1972 | Bliss et al. | 53/442 |
| 3,791,100 | 2/1974 | Monaghan | 53/74 |
| 4,036,362 | 7/1977 | Ullman | 53/557 |
| 4,182,095 | 1/1980 | Day | 53/557 |
| 4,457,122 | 7/1984 | Atkins et al. | 53/557 |
| 4,592,193 | 6/1986 | Gustavsson | 53/530 |
| 4,642,969 | 2/1987 | Johnson | 53/442 |
| 4,870,802 | 10/1989 | Cerf | 53/442 |
| 5,009,057 | 4/1991 | Wilkinson | 53/439 |
| 5,155,799 | 10/1992 | Andersson et al. | 392/473 |
| 5,193,290 | 3/1993 | Tolson | 34/12 |
| 5,237,800 | 8/1993 | Omori | 53/442 |
| 5,299,410 | 4/1994 | Freeman | 53/442 |
| 5,339,605 | 8/1994 | Simpson, Sr. et al. | 53/439 |
| 5,381,644 | 1/1995 | DiBernardo | 53/557 |
| 5,390,477 | 2/1995 | Sowden | 53/557 |
| 5,398,427 | 3/1995 | Tolson | 34/389 |
| 5,400,570 | 3/1995 | Bennett | 53/442 |
| 5,546,677 | 8/1996 | Tolson | 34/216 |
| 5,619,843 | 4/1997 | Ganz | 53/543 |
| 5,746,041 | 5/1998 | Tolson | 53/442 |

FOREIGN PATENT DOCUMENTS 8912256 2/1990 Germany .

OTHER PUBLICATIONS

GB Industrial Opportunities LTD. Havant, "Hot Air Shrink System Using a Modified Sealer Cooler", Abstract No. 382, Feb. 1996, p. 116.

*Primary Examiner*—Eugene Kim

*Attorney, Agent, or Firm*—Pearson & Pearson; Walter F. Dawson

[57] ABSTRACT

An apparatus and method for controlling the size and shape of a shrink film envelope around an article or a package to prevent the formation of wrinkles and bunching of the film when it shrinks. The apparatus comprises a hot air shrink tunnel having a conveyor for moving the article on packages through the tunnel. An assembly is position within the tunnel a preadjusted distance away from the article forming a fixed boundary to which the film envelope expands and is restricted, causing the air within the film envelope to be directed to areas around the article to keep the film from touching the article until the film shrinks. The assembly comprises material of low thermal conductivity such as a plurality of wooden wheels for contacting the film envelope.

18 Claims, 7 Drawing Sheets

METHOD AND APPARATUS FOR CONTROLLING SHRINKAGE OF A THIN FILM

BACKGROUND OF THE INVENTION

1. Field of the Invention

This invention relates generally to a method and apparatus for packaging articles in a heat shrinkable film and in particular to a method and apparatus for controlling the volume and shape of the shrinkable film as it passes through a heat shrink tunnel without the film prematurely touching the article.

2. Description of Related Art

The use of plastic films known as shrink film for packaging food or other products is an art that dates back to the 1930's. It is well established that when such heat shrinkable films are exposed to a blast of hot air or bath of hot water they will contract to a much smaller film dimension. These films are generally specially treated polyolefins, irradiated polyolefins, polyolefin copolymers, polyvinyl chloride or polyesters.

The first thing that occurs in the shrinking process is that the film is drawn around an article and sealed. This makes an air tight (with the exception of small vent holes) film bag (bubble). In order to shrink the film in an even manner, without excessive wrinkles and/or film bunching on package corners (known as "ears"), various devices were devised to vent air from the film bag. These holes in the film allowed the entrapped air to escape as the film shrinks under the influence of heated air. Such holes are known in the art as "vent holes".

Prior art focused on controlling the rate of speed of this air exhaust. Vent holes were originally die-cut approximately ¼" in diameter or burned (size was more random) in the film. Typically two vent holes would be provided to exhaust the air. Later the hole was decreased to 3/16" or ⅛" diameter to improve venting by delaying the total collapse of the film bubble around the package as long as possible to effect a better looking package. A still further improvement of controlling air exhaust rate, was found by providing a series of small pin holes in place of a single hole. In each case the progression of improvements resulted in a package with less wrinkling and smaller ears.

The problem with all of these prior art improvements is that the articles with very thin or flat side walls, very high side walls, such as a cube, or an article with high thermal conductivity, for example metal spray cans, or an article with an irregular shape, leaves most packages with unacceptable wrinkling and ears, unless considerable time is spent in adjusting air flow, belt speed, etc., in the shrink tunnel. In fact with any article, considerable time is spent adjusting wrappers and tunnels to improve package appearance.

In the ideal situation, when a thin film shrinks onto a product there would be no interaction between the product and the film until the film is completely shrunk around the package during the shrinking process. The product, by not coming in contact with the film, would be unable to remove heat from the film as the film contracts during the shrinking process. As a result the film would be able to evenly shrink around the product without having heat sucked out as it touches, for example, the side or end walls of the product.

In the extreme, a product can have a high thermal mass such as a frozen turkey. This mass can have a tremendous effect on the quality of the shrink. In the case of the frozen turkey, the only way to get a smooth wrinkle free shrink is to use a water bath just below boiling temperature. If shrink wrapping is carried out on a frozen turkey in a hot air tunnel there would be very poor shrinking with many wrinkles. This is due to the thermal mass of the turkey being far greater than the driving force of the hot air. The frozen turkey pulls the heat out of the film faster than the hot air can heat the film.

U.S. Pat. No. 5,009,057 issued Apr. 23, 1991 to Frank G. Wilkinson discloses a method and apparatus for shrink wrapping comprising a hot air chamber for blowing hot air on the shrink film while an article covered by the shrink film is on a conveyor and a plurality of rollers mounted on a support frame above the conveyor. This method requires holding the shrink film covered article down against the tunnel conveyor by exerting pressure from at least one of the plurality of rollers on the covered article. This method is intended for use with light objects which float or thin or flimsy articles that are easily deformed or warped. Wilkinson teaches the use of silicon rubber covered roller cylinders to transmit heat to an article. The high thermal conductivity of these rollers can actually melt the film during shrinking.

U.S. Pat. No. 5,339,605 issued Aug. 23, 1994 to Billy J. Simpson et al. discloses a shrink tunnel having an upper secondary conveyor adapted to compress a wrapped article during an initial period of the article's passage through the shrink tunnel removing any air trapped between the folds of a textile article such as bed sheets. However, this apparatus requires driven rollers and the additional overhead conveyor for compressing the article. This method is also intended for use with light objects which float or thin and flimsy articles that are easily deformed or warped. This is expensive and time consuming to install into an existing shrink tunnel.

U.S. Pat. No. 5,400,570 issued Mar. 28, 1995 to Charles J. Bennet describes a method for heat shrinking film around a cold food product. In shrink tunnels using hot air, shrinking stops when the film contacts cold food even in the presence of hot moving air. Bennet describes the use of a combination of a first assembly for providing heated air to a bottom portion of the film and a second assembly for directing heated water into at least a top portion of the film envelope. However, this invention requires complex equipment in order to overcome the problems related to shrinking films on cold products.

SUMMARY OF INVENTION

Accordingly it is therefore an object of this invention to provide a method and apparatus for shrink wrapping a product or article free of wrinkles and ears.

It is another object of this invention to provide a method and apparatus for controlling the size and shape of a shrink film bag/bubble without touching the article being wrapped, as it travels through a hot air tunnel.

It is another object of this invention to provide a method for shrink wrapping products of high thermal mass or high thermal conductivity such as a metal aerosol can or a frozen aluminum block using a hot air tunnel.

It is further object of this invention to provide an apparatus for controlling the size and shape of a shrink film bag/bubble which is easily adaptable to existing shrink tunnels.

It is another object of this invention to provide a plurality of wheels assembly a predetermined distance above an article for controlling the size and shape of a shrink film around the article in a heat shrink tunnel, the wheels being unable to mover vertically once fixed in position.

These and other objects are further accomplished by providing an apparatus for heat shrinking an envelope of heat shrinkable film into close conformity to an article enclosed within the film envelope comprising means for providing hot air around the envelope of heat shrinkable film while air within the film envelope expands and insulates the film from the article as the film shrinks, means for conveying the article through the hot air providing means, means for controlling the size and shape of the film envelope, as the film envelope enclosing the article travels through the hot air on the conveying means, to manipulate the film from touching the article and slowing the exhaust of the air within the film envelope prior to the film shrinking around the article, and the film envelope controlling means comprises an assembly positioned within the apparatus a fixed predetermined distance away from the article, the assembly forming a fixed boundary to which the film envelope expands and is restricted, causing the air within the film envelope to be directed to areas around the article to keep the film from touching the article until the film shrinks. The envelope of heat shrinkable film comprises perforations to allow entrapped air to escape during the shrinking of the film envelope. A portion of the assembly in contact with the film envelope comprises material of low thermal conductivity. Depending on the package shape, the film envelope controlling means may have at least one side assembly having a plurality of the rotatable devices positioned in the direction of the conveying means movement. The apparatus comprises means for adjusting the assembly the predetermined distance away from the article prior to conveying the article through the hot air providing means, the boundary set by the assembly having no vertical displacement during conveyance of the article through the hot air providing means. The hot air providing means comprises a shrink tunnel. The assembly comprises a plurality of rotatable devices. The assembly includes a plurality of wheels positioned a predetermined distance from each other along parallel rods. The wheels comprise wood or other material of low thermal conductivity. The assembly may be embodied by a wood plane having a plurality of holes. The assembly may also comprise a plurality of cylindrical rollers each of the cylindrical rollers having a low thermal conductivity material.

The objects are further accomplished by providing a method for heat shrinking an envelope of heat shrinkable film into close conformity to an article enclosed within the film envelope comprising the steps of providing hot air around the envelope of heat shrinkable film while air within the film envelope expands and insulates the film from the article as the film shrinks, moving the article through the hot air with a conveyor means, controlling the size and shape of the film envelope with an assembly as the film envelope enclosing the article travels through the hot air on said conveying means, to manipulate the film from touching the article and slowing the exhaust of the air within the film envelope prior to the film shrinking around said article, positioning said assembly within the apparatus a fixed predetermined distance away from the article, and forming a fixed boundary with the assembly a fixed predetermined distance away from the article to which the film envelope can expand and be restricted, and causing the air within the film envelope to be directed to areas around the article to keep the film from touching the article until the film shrinks. The method comprises the step of providing the envelope of heat shrinkable film with perforations to allow entrapped air to escape during the shrinking of the film envelope. The step of controlling the size and shape of the film envelope enclosing the article comprises the step of providing the assembly with a plurality of wheels, the wheels comprising material of low thermal conductivity. The step of controlling the size and shape of the film envelope with the assembly positioned within the apparatus also comprises the step of providing at least one side assembly in accordance with the shape of the article having the plurality of wheels positioned for rotation in the direction of the conveyor means movement. The step of controlling the size and shape of the film envelope by positioning the assembly a fixed predetermined distance away from the article comprises the step of adjusting the assembly a predetermined distance away from the article, in accordance with the size of the article, prior to moving the article on the conveyor means through the hot air, the assembly having no vertical displacement during the heat shrinking of the film. The step of providing hot air to the envelope of heat shrinkable film comprises the step of providing a heat shrink tunnel means. The step of providing the assembly with the wheels comprising low thermal conductivity material comprises the step of providing wooden wheels.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
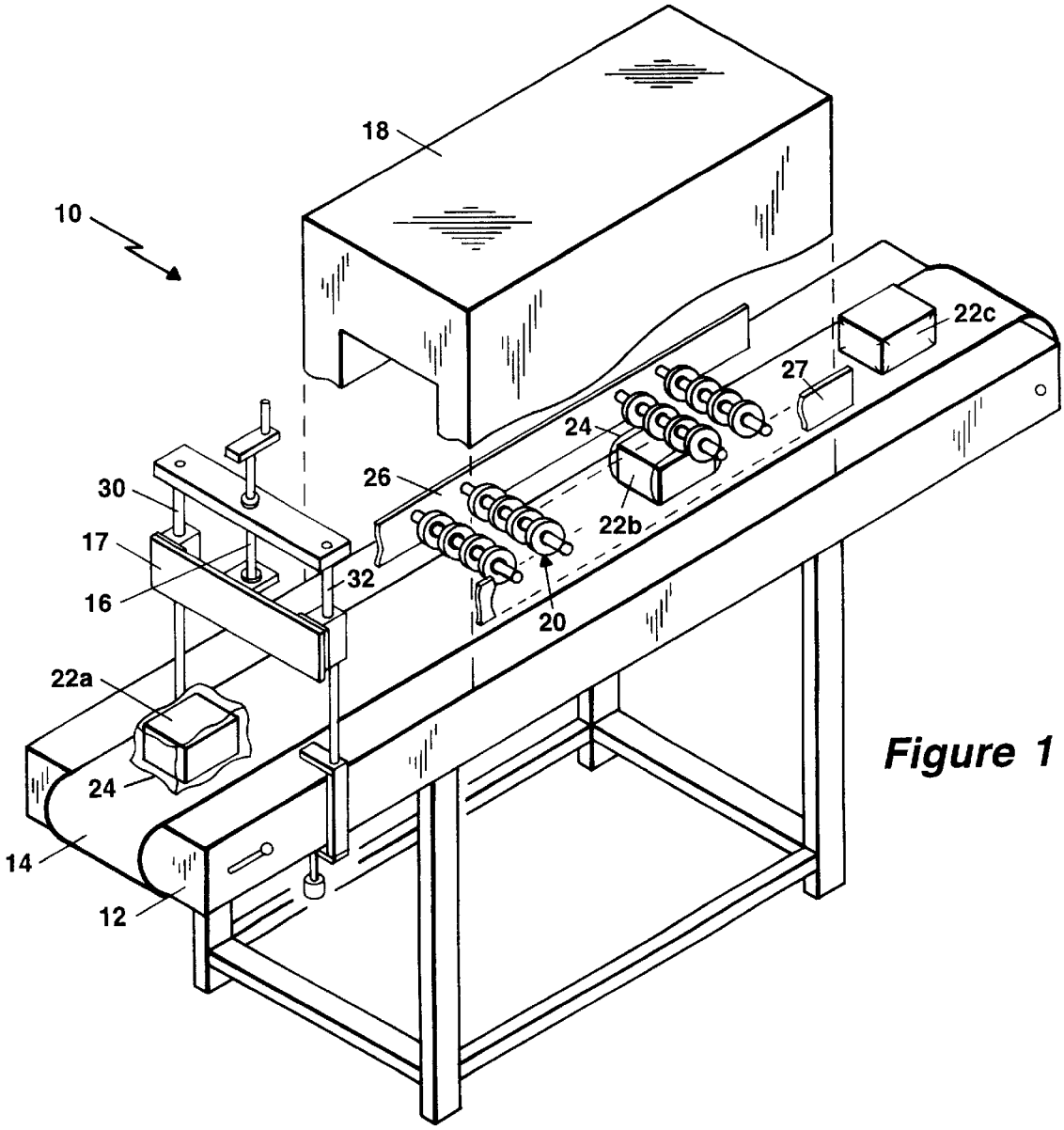
FIG. 1 is a perspective view of a heat shrink apparatus having a portion of the side walls cutaway showing a plurality of wheels assembly according to the invention.

Referring to FIG. 1 a perspective view of heat shrink apparatus 10 comprising the invention is shown for controlling the volume and shape of a shrink film bag or bubble so as to not prematurely touch a package 22*b* and producing a shrink wrapped package free of wrinkles and film bunching on the package corners (known as ears). The heat shrink apparatus 10 comprises a conveyor table 12 having a conveyor belt 14 for moving packages 22*a*, 22*b*, 22*c* covered with heat shrinkable film 24 through a heated shrink tunnel 18. A plurality of wheels assembly 20 is positioned in a horizontal plane above the conveyor 14 at a predetermined height depending on the height of a package being shrink wrapped in order to keep the film from touching the package prior to shrinking. The plurality of wheels assembly 20 is attached by two side bars 26, 27 to a panel 17 outside the shrink tunnel 18. Each side of the panel 17 comprises vertically positioned cylindrical openings through which columns 30, 32 are inserted. A crank rod 16 raises or lowers the plurality of wheels assembly 20 to the predetermined fixed position appropriate for the size of package being shrink wrapped. One of ordinary skill in the art will recognize that other methods of attaching the plurality of wheels assembly 20 within the shrink tunnel 18 are available to control the volume and shape of a shrink film bag or bubble around an article or package 22*a,* 22*b,* 22*c.*

Figure 2:
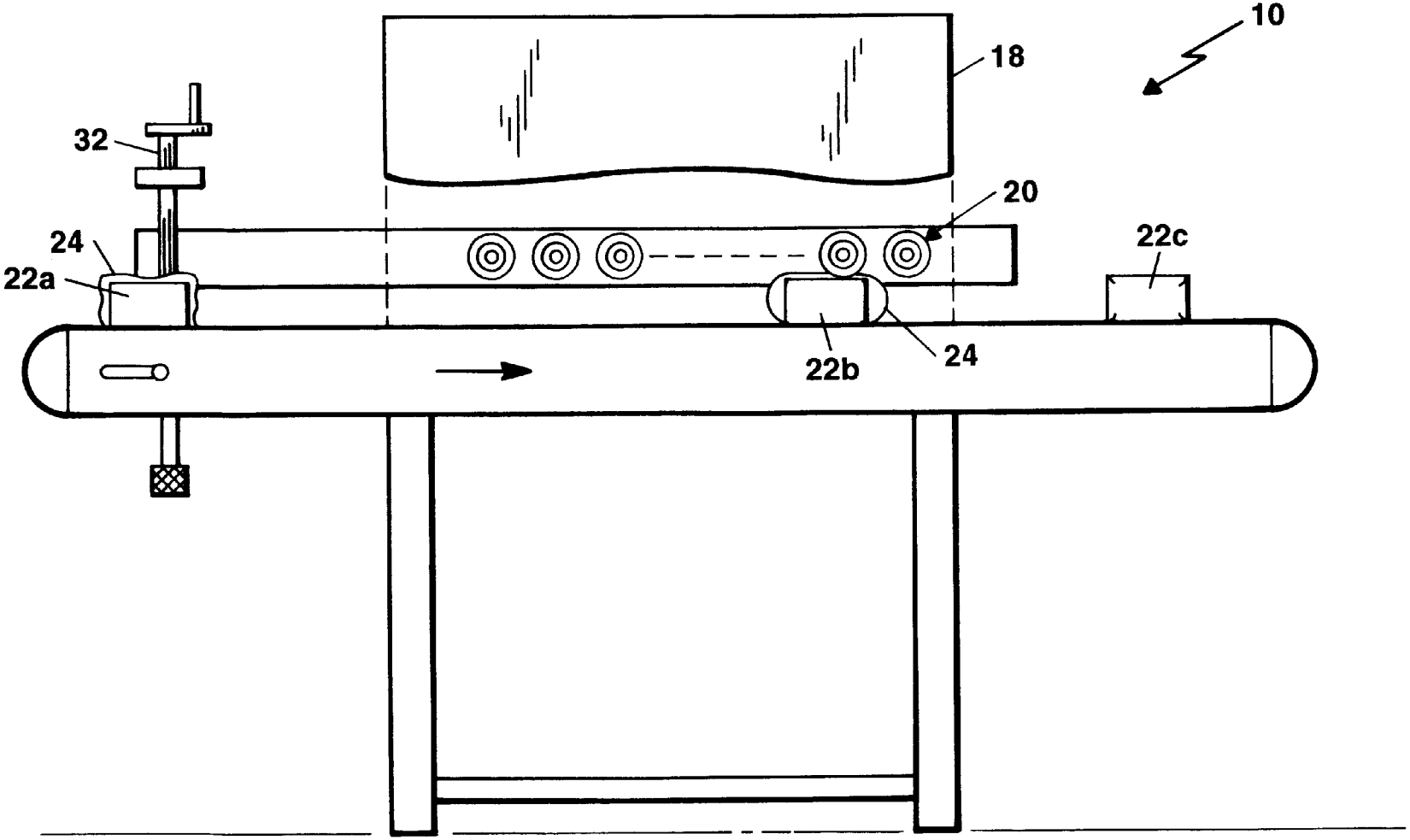
FIG. 2 is a side elevational view of a shrink tunnel overhead conveyor showing articles on a conveyor belt covered with shrink film being shaped by a plane of randomly positioned wheels fixed at a predetermined distance above the articles.

Referring now to FIG. 2 a side elevational view of the heat shrink apparatus 10 having portions of the sides cutaway showing the plurality of wheels assembly 20 positioned over a product 22*b.* The product 22*a* comprises shrink film 24 surrounding the product. In FIG. 2 a ballooning of the shrink film 24 is illustrated at the front and rear of the product 22*b* as it proceeds through the heated shrink tunnel 18 encountering hot air. The plurality of wheels assembly 20 limits the ballooning on the top of the product 22*b* which results in a perfect shrink wrap around such product. The shrink tunnel apparatus 18 provides the heat (typically 270° F.) for shrinking the shrink film 24 and may be embodied by model T-7H manufactured by Shanklin Corporation of Ayer, Mass.

Figure 3A:
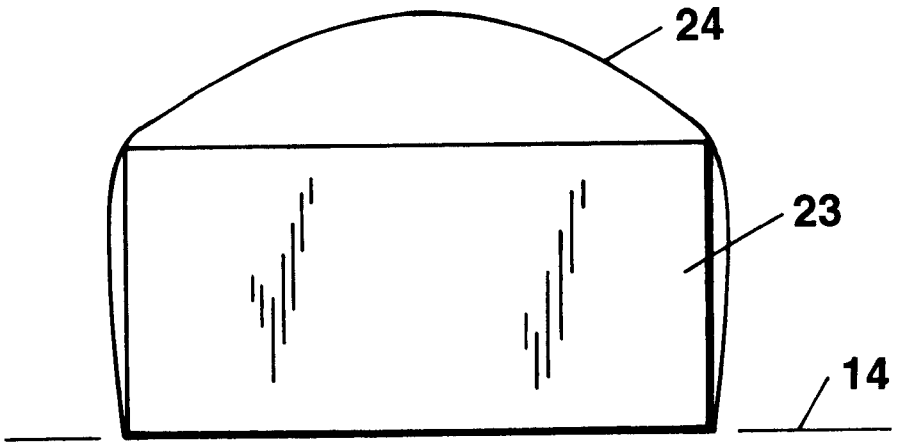
FIG. 3*a* shows an end view of ballooning of shrink film around an article when hot air is encountered along a conveyor.
Figure 3B:
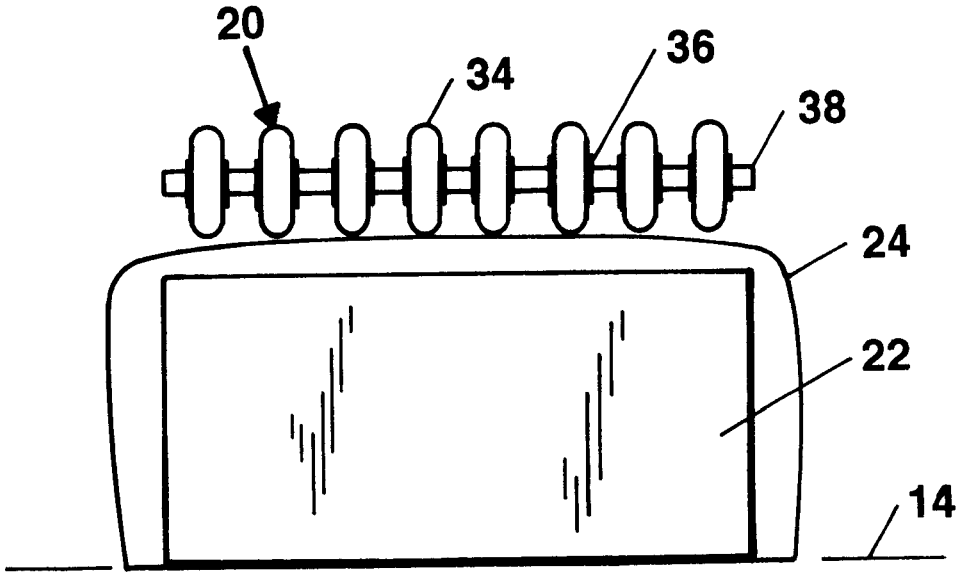
FIG. 3*b* shows an end view of the ballooning of shrink film around an article being controlled by a plurality of wheels above the article but not touching the article.

Referring to FIG. 3*a,* a product 22 covered with shrink film 24 is shown illustrating the normal and typical ballooning of the shrink film 24 upon encountering hot air within the shrink tunnel 18. A portion of a plurality of wheels assembly 20 shown in FIG. 3*b* causes the shrink film 24 to be compressed and flare on each side of the product 22. The number of wheels 34 to be positioned on each rod 38 is determined by the size of a product 22.

Figure 4:
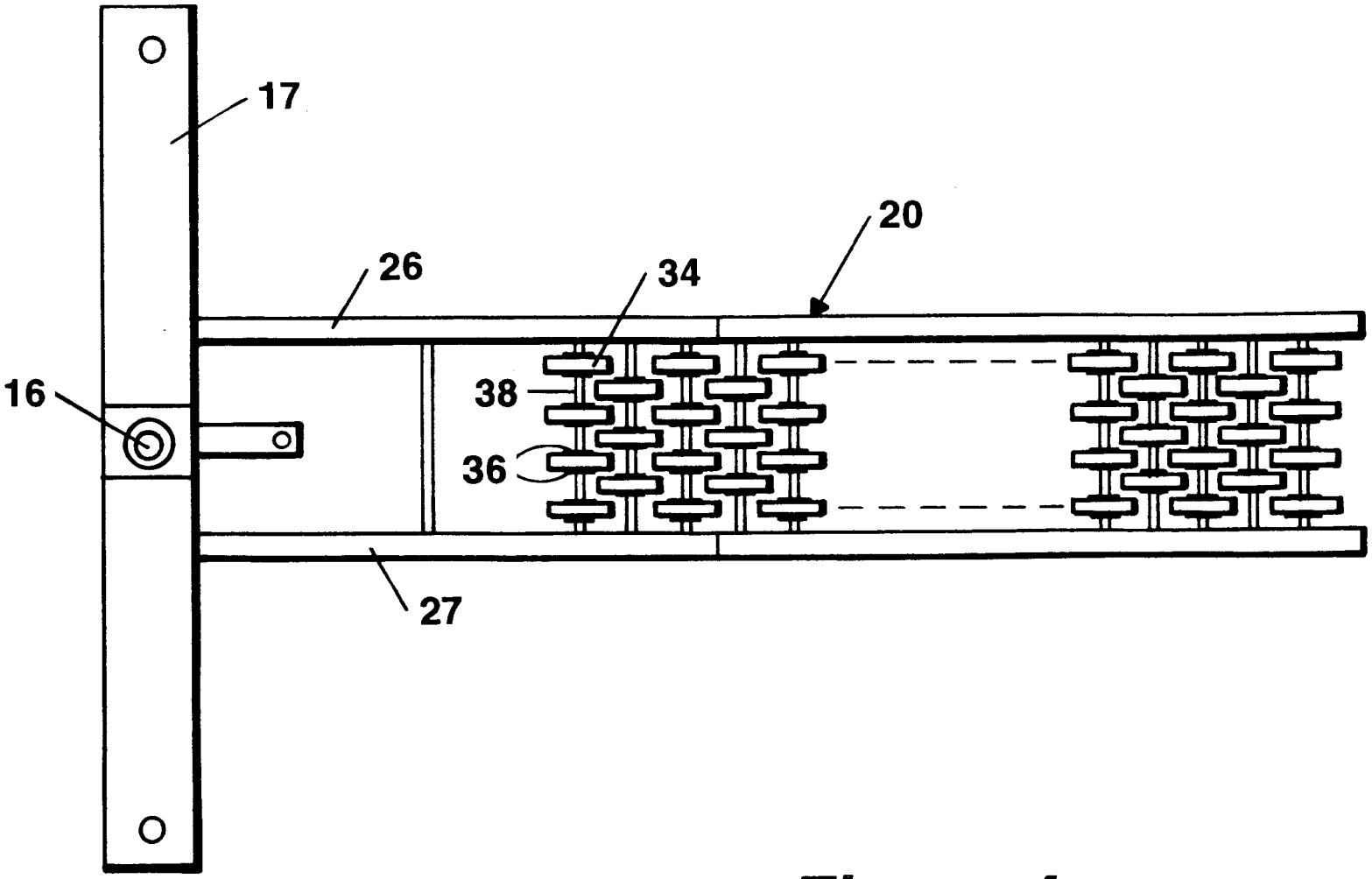
FIG. 4 is a top view of a plurality of wheels assembly of the shrink wrap apparatus.

Referring to FIG. 4, a top view of the plurality of wheels assembly 20 is shown comprising a plurality of rods 38 which are parallel to each other and extend between side bars 26, 27. Each rod 38 comprises a plurality of wheels 34, the number of wheels and rods being determined by the size of a package or article being shrink wrapped. On either side of each wheel 34 are movable O-ring retainers 36 which are used to keep each wheel 34 in a predetermined position along the rod 38. For example, the wheels may be positioned with either more or less space between them depending on the size or shape of the package being shrink wrapped. The wheels 34 must be constructed of low thermal conductivity material such as wood and must not touch the product through the film, but only touch the shrink film 24. The plurality of wheels assembly 20 is rigidly mounted to the panel 17 so that the plurality of wheels 20 are able to overcome the internal shrink film bag air pressure. The wheels 34 may be embodied by hard maple wood wheels having dimensions of 2" diameter by ¾" thick with a 13/32" hole, procured from Stolle Wood Products Company of Des Plaines, Fla.

Figure 5:
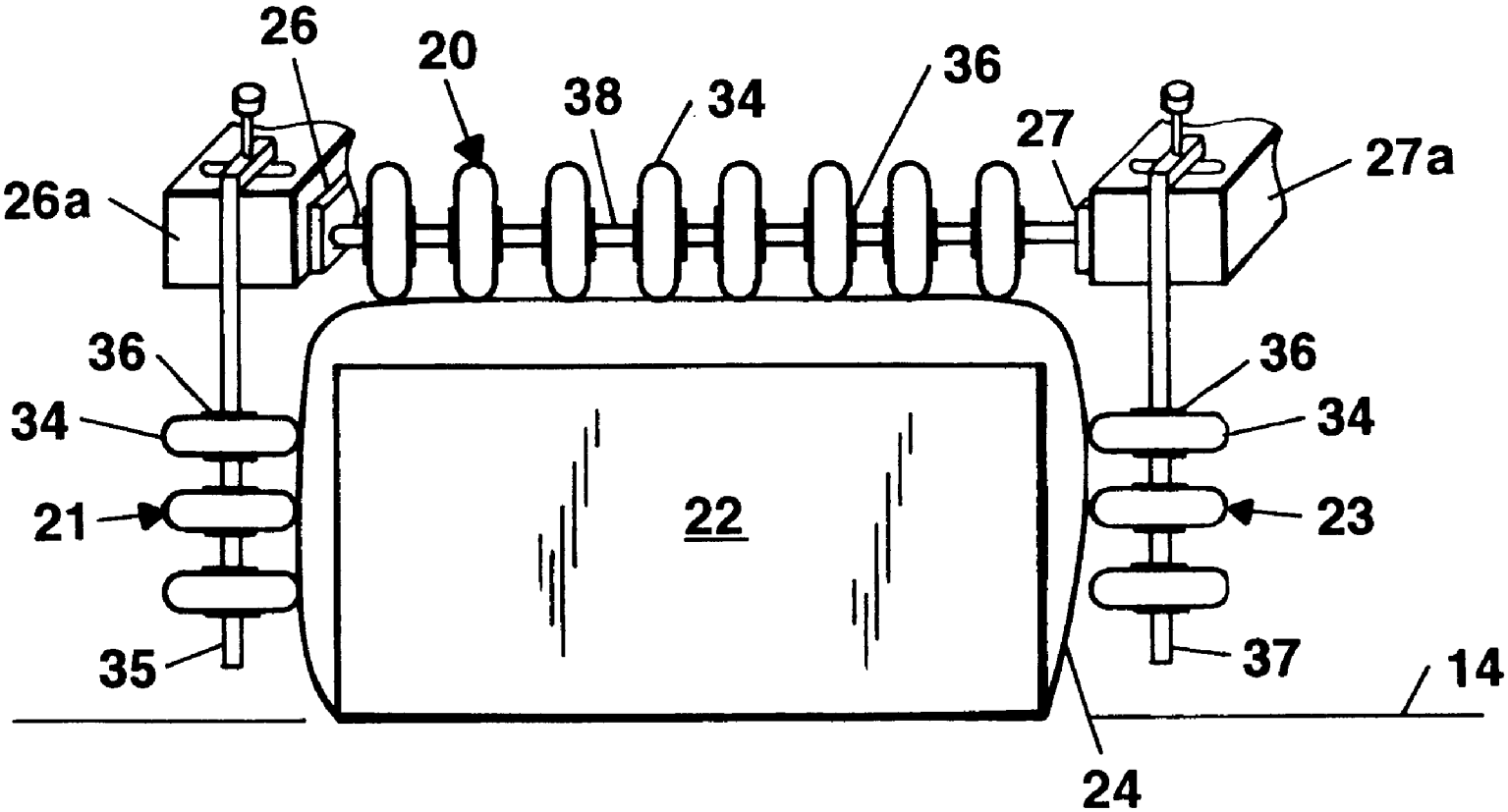
FIG. 5 is an end view of an alternate embodiment of the invention showing a first plurality of wheels assembly positioned above a product being shrink wrapped and a second and third plurality of wheels assembly positioned on both sides of the product.

Referring now to FIG. 5, an end view of an alternate embodiment of the invention is shown comprising not only a plurality of wheels assembly 20 above a product passing through the shrink tunnel 18, but also two vertically positioned plurality of wheels assemblies 21 and 23 positioned on each side of the shrink tunnel 18 depending on the product size and shape being shrink wrapped. The vertical rods 35, 37 of assemblies 21, 23 may be adjusted toward or away from the film 22. The vertical rack 35, 37 are supported by side extensions 26*a,* 27*a* which attach to corresponding side bars 26, 27. In some applications only one side assembly of wheels may be required.

Figure 6:
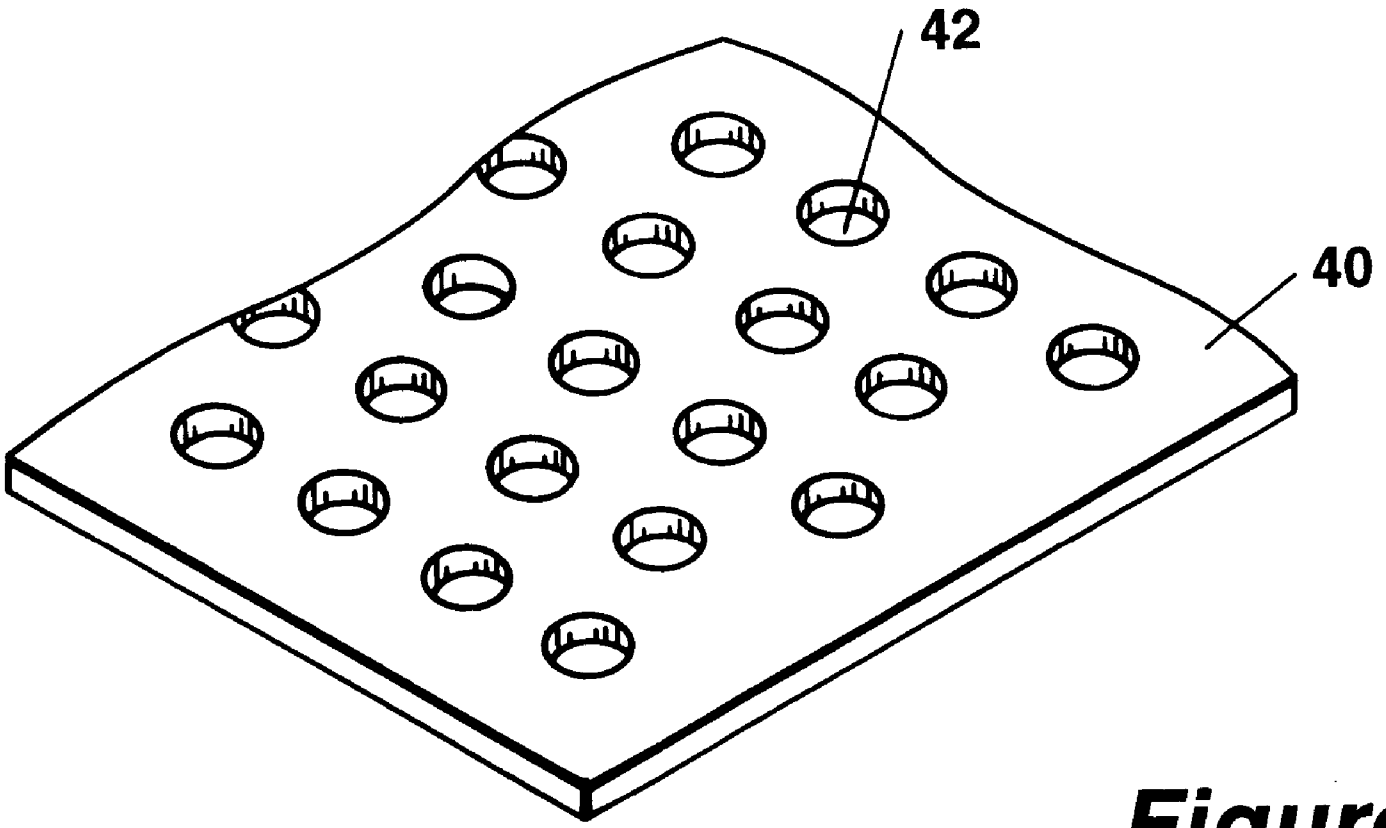
FIG. 6 is a perspective view of an alternate device of low thermal conductivity for controlling the way a heat shrinkable film forms around a product.

Referring to FIG. 6, a perspective view of an alternate device for controlling the way a heat shrinkable film forms around a product. The plane of wheels assembly 20 in FIG. 1 is replaced by the board plane assembly 40 of low thermal conductivity such as provided by wood having a plurality of holes 42.

Figure 7:
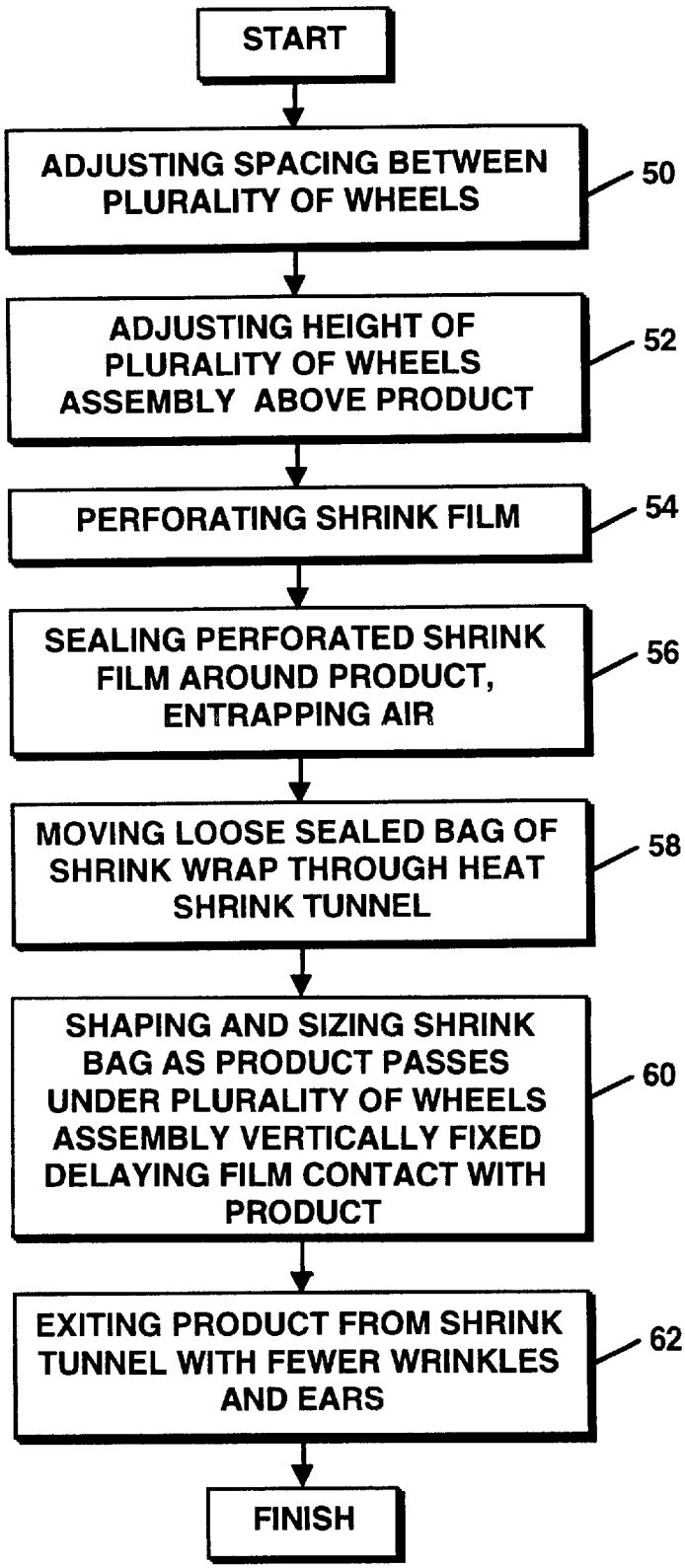
FIG. 7 is a flow chart of the method for controlling the shape and size of a shrink wrap bubble around a product.

Referring now to FIG. 7, a flow chart shows the method of controlling and shaping an amount of heat shrinkable film around a product. The first step 50 calls for adjusting the spacing between the plurality of wheels 34 on each rod 38 by means of O-rings 36 on each side of each wheel. The O-rings 36 are moveable along the rod with a minimum amount of force. The next step 52 adjusts the height of the plurality of wheels assembly 20 above the product 22*a* covered with shrink wrap film 24. Next in step 54, the shrink film 24 is perforated (not shown) and in step 56, shrink film 24 is sealed around the product entrapping air in the resulting loose film bag 24. The perforations allow entrapped air to escape in a time controlled manner during the subsequent heat shrink step. It has been long established that controlling and slowing the exhaust rate significantly improves the finished package appearance.

The next step 58 includes moving the loose sealed film bag 24 via the conveyor belt 14 through the heat shrink tunnel 30. Once in the tunnel, the heat allows the shrink film to release its shrink energy against the air inside the bag. As the film bag contracts, it attempts to squeeze the entrapped air out through the perforated vent holes. Because the vent holes cannot exhaust air fast enough, the bag "balloons". The film bag/bubble, now taut from interval air pressure, naturally achieves a more spherical shape as illustrated in FIG. 3*a,* with the majority of the entrapped air towards the top of the film bag, above the product.

The next step 60 comprises shaping and sizing the taut, rounded shrink film bag 24 as the product passes under the plurality of non-yielding wheels assembly 20 delaying film contact with the product 22*b.* The vertically fixed wheels 34 can not be pushed upward or outward by the air pressure within the film bag. The film bag 24 is shaped more closely to the profile of the product. The rounded bag is forced to be more "square" (e.g. game box) which is the profile of most products wrapped by this method in order to keep the film bag from touching the product 22*b* prematurely prior to the film shrinking around the product 22*c.*

Finally, after the air finishes exhausting and the film 24 finishes shrinking, in step 62 the completed shrink wrapped product 22*c* exits the shrink tunnel 30. The resulting package has a more pleasing appearance with fewer wrinkles and "ears" (excessive shrink film on package corners), if any at all.

Reshaping the film bag, causes the internal air to form an "insulating buffer" between the film 24 and the product 22*b.* Otherwise, when the film bag "rounds" out in a spherical shape, film contact with the internal product is excessive. This buffer of uniformly distributed air delays the heated film from touching the internal product. The film bag is more balanced in appearance and results in: a) The film absorbing more heat because it is not losing it through product contact; b) The film can heat for longer periods of time and thereby more shrink energy can be released; and c) By adjusting the location of the plurality of wheels assemblies 20, 21, the internal air is redirected to more advantageous areas inside the film bag.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. Apparatus for heat shrinking an envelope of heat shrinkable film into close conformity to an article enclosed within the film envelope comprising:

means for providing hot air around said envelope of heat shrinkable film while air within said film envelope expands and insulates said film from said article as said film shrinks;

means for conveying said article through said hot air providing means;

means for controlling the size and shape of said film envelope, as said film envelope enclosing said article travels through said hot air on said conveying means, to manipulate said film from touching said article and slowing the exhaust of said air within said film envelope prior to said film shrinking around said article; and said film envelope controlling means comprises an assembly positioned within said apparatus a fixed predetermined distance away from said article, said assembly forming a fixed boundary to which said film envelope expands and is restricted, causing said air within said film envelope to be directed to areas around said article to keep said film from touching said article until said film shrinks.

2. The apparatus as recited in claim 1 wherein said envelope of heat shrinkable film comprises perforations to allow entrapped air to escape during the shrinking of said film envelope.

3. The apparatus as recited in claim 1 wherein a portion of said assembly in contact with said film envelope comprises material of low thermal conductivity.

4. The apparatus as recited in claim 1 wherein said assembly comprises a plurality of rotatable devices.

5. The apparatus as recited in claim 4 wherein said film envelope controlling means comprises at least one side assembly in accordance with the shape of said article having said plurality of said rotatable devices positioned in the direction of said conveying means movement.

6. The apparatus as recited in claim 1 wherein said apparatus comprises means for adjusting said assembly said predetermined distance away from said article prior to conveying said article through said hot air providing means said boundary set by said assembly having no vertical displacement during conveyance of said article through said hot air providing means.

7. The apparatus as recited in claim 1 wherein said hot air providing means comprises a shrink tunnel.

8. The apparatus as recited in claim 1 wherein said assembly comprises a plurality of wheels positioned a predetermined distance from each other along parallel rods.

9. The apparatus as recited in claim 8 wherein said wheels comprise material of low thermal conductivity including wood.

10. The apparatus as recited in claim 1 wherein said assembly comprises a wood plane of low thermal conductivity having a plurality of holes.

11. The apparatus as recited in claim 1 wherein said assembly comprises a plurality of cylindrical rollers each of said cylindrical rollers comprises a low thermal conductivity material.

12. A method for heat shrinking an envelope of heat shrinkable film into close conformity to an article enclosed within the film envelope comprising the steps of:

providing hot air around said envelope of heat shrinkable film while air within said film envelope expands and insulates said film from said article as said film shrinks;

moving said article through said hot air with a conveyor means;

controlling the size and shape of said film envelope with an assembly as said film envelope enclosing said article travels through said hot air on said conveying means, to manipulate said film from touching said article and slowing the exhaust of said air within said film envelope prior to said film shrinking around said article;

positioning said assembly within said apparatus a fixed predetermined distance away from said article; and forming a fixed boundary with said assembly said fixed predetermined distance away from said article to which said film envelope can expand and be restricted, causing said air within said film envelope to be directed to areas around said article to keep said film from touching said article until said film shrinks.

13. The method as recited in claim 12 wherein said method comprises the step of providing said envelope of heat shrinkable film with perforations to allow entrapped air to escape during the shrinking of said film envelope.

14. The method as recited in claim 12 wherein said step of controlling the size and shape of said film envelope enclosing said article comprises the step of providing said assembly with a plurality of wheels, said wheels comprising material of low thermal conductivity.

15. The method as recited in claim 14 wherein said step of controlling the size and shape of said film envelope with said assembly positioned within said apparatus comprises the step of providing at least one side assembly having said plurality of wheels positioned for rotation in the direction of said conveyor means movement.

16. The method as recited in claim 12 wherein said step of controlling the size and shape of said film envelope by positioning said assembly a fixed predetermined distance away from said article comprises the step of adjusting said assembly said predetermined distance away from said article, in accordance with the size of said article, prior to moving said article on said conveyor means through said hot air, said assembly having no vertical displacement during said heat shrinking of said film.

17. The method as recited in claim 12 wherein said step of providing hot air to said envelope of heat shrinkable film comprises the step of providing a heat shrink tunnel means.

18. The method as recited in claim 14 wherein said step of providing said assembly with said wheels comprising low thermal conductivity material comprises the step of providing wooden wheels.

* * * * *